US009290256B1

(12) United States Patent
Wireman et al.

(10) Patent No.: US 9,290,256 B1
(45) Date of Patent: Mar. 22, 2016

(54) SYSTEMS AND METHODS FOR STEERING A TROLLING MOTOR

(71) Applicant: Brunswick Corporation, Lake Forest, IL (US)

(72) Inventors: Justin M. Wireman, Comstock Park, MI (US); Benjamin David Curtis, Grand Rapids, MI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/541,426

(22) Filed: Nov. 14, 2014

(51) Int. Cl.
*B63H 25/42* (2006.01)
*B63H 21/21* (2006.01)

(52) U.S. Cl.
CPC ..... *B63H 25/42* (2013.01); *B63H 21/21* (2013.01); *B63H 2021/216* (2013.01)

(58) Field of Classification Search
CPC ..... B63H 20/00; B63H 20/10; B63H 20/007; B63H 20/12; B63H 21/17; B63H 21/22; B63H 5/125; B63H 25/42; B63H 21/21; B60L 11/02; B60L 15/20
USPC ..... 114/144 R; 440/6, 7, 62, 63
See application file for complete search history.

(56) References Cited

U.S. PATENT DOCUMENTS 3,511,208 A 5/1970 Woodruff
3,606,858 A 9/1971 Edwards
3,807,345 A 4/1974 Peterson
4,051,802 A 10/1977 Russell
4,151,807 A 5/1979 Black
4,631,034 A 12/1986 Menne
4,824,408 A 4/1989 Aertker
5,171,173 A 12/1992 Henderson
5,171,174 A * 12/1992 Mynster ..... B63H 25/42 440/7
5,172,324 A 12/1992 Knight
5,202,835 A 4/1993 Knight
5,355,821 A 10/1994 Johnson
5,386,368 A 1/1995 Knight
5,465,633 A 11/1995 Bernloehr
5,491,636 A 2/1996 Robertson
5,884,213 A 3/1999 Carlson
6,126,497 A 10/2000 Stockton
6,170,600 B1 1/2001 Shimizu
6,325,684 B1 12/2001 Knight
6,325,685 B1 12/2001 Knight
6,678,589 B2 1/2004 Robertson
6,758,705 B1 7/2004 Bechtel
8,221,175 B2 * 7/2012 Mynster ..... B63H 20/12 114/144 R

* cited by examiner

*Primary Examiner* — Lars A Olson
(74) *Attorney, Agent, or Firm* — Andrus Intellectual Property Law, LLP

(57) ABSTRACT

A steering system for a trolling motor includes a mechanical steering system having a mechanical steering input device and a mechanical linkage extending from the mechanical steering input device to a steering shaft of the trolling motor. Movement of the mechanical steering input device causes movement of the mechanical linkage, which in turn causes rotation of the steering shaft. An electromechanical actuation system is provided that is configured to be coupled to the mechanical steering system. A controller is in signal communication with the electromechanical actuation system and provides steering signals thereto. The electromechanical actuation system selectively actuates the mechanical steering system so as to rotate the steering shaft according to the steering signals provided by the controller. A method for steering a trolling motor is also provided.

20 Claims, 11 Drawing Sheets

SYSTEMS AND METHODS FOR STEERING A TROLLING MOTOR

FIELD

The present disclosure relates to trolling motors, and more specifically to systems and methods for steering trolling motors.

BACKGROUND

Many fishing boats include trolling motors mounted at the bow or stern of the boat, which an operator of the boat may use to propel the boat to a selected fishing spot. Often, the trolling motor is provided in addition to a larger motor, such as an outboard motor, and provides slower speeds than the larger motor, which are desirable for both precise positioning and for fishing while the boat is moving through a waterway. The trolling motor is often part of a trolling motor system that allows the operator to control both the steering and speed of the trolling motor.

U.S. Pat. No. 3,511,208 discloses an auxiliary power attachment for fishing boats adapted for mounting on the bow of the boat to permit an occupant in the boat to maneuver the same without the use of the hands. The device consists in an electric motor connected to the battery normally used with the boats engine. The motor is fastened to a hollow shaft pivotally mounted at the bow of the boat which permits the motor to lie in a transporting position on the boat deck, yet permits the same to be swung arcuately over the bow of the boat and into the water. The device includes a remote foot control of the motor speed together with a control of the hollow shaft which may be turned radially to thus position the motor and its propeller to guide the boat.

U.S. Pat. No. 5,884,213 discloses a system for controlling the navigation of a fishing boat between waypoints representing successive positions around a navigation route. The system includes an input device for setting the waypoint positions, a position detector to detect the actual position of the fishing boat, a trolling motor to produce a thrust to propel the fishing boat, a steering motor to control the direction of the thrust, and a heading detector to detect the actual heading of the fishing boat. The system also includes a control circuit which determines a desired heading using a desired waypoint and the actual position of the fishing boat, and generates a steering control signal applied to the steering motor to steer the fishing boat from the actual position to the desired waypoint. The system operates in various modes which allow repeated navigation of the fishing boat around a navigation route. The system provides for automatic waypoint storage as the fishing boat is maneuvered around a navigation route.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One example of the present disclosure includes a steering system for a trolling motor. The steering system includes a mechanical steering system including a mechanical steering input device and a mechanical linkage extending from the mechanical steering input device to a steering shaft of the trolling motor. Movement of the mechanical steering input device causes movement of the mechanical linkage, which in turn causes rotation of the steering shaft. The steering system also comprises an electromechanical actuation system configured to be coupled to the mechanical steering system and a controller in signal communication with the electromechanical actuation system for providing steering signals thereto. The electromechanical actuation system selectively actuates the mechanical steering system so as to rotate the steering shaft according to the steering signals provided by the controller.

Another example of the present disclosure includes a method for steering a trolling motor. The method includes providing a mechanical steering system including a mechanical steering input device and a mechanical linkage extending from the mechanical steering input device to a steering shaft of the trolling motor, and providing an electromechanical actuation system configured to be coupled to the mechanical steering system. The method includes selectively manually actuating the mechanical steering system so as to rotate the steering shaft and selectively actuating the mechanical steering system with the electromechanical actuation system so as to rotate the steering shaft.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed. The different systems and methods described herein may be used alone or in combination with other systems and methods.

Figure 1:
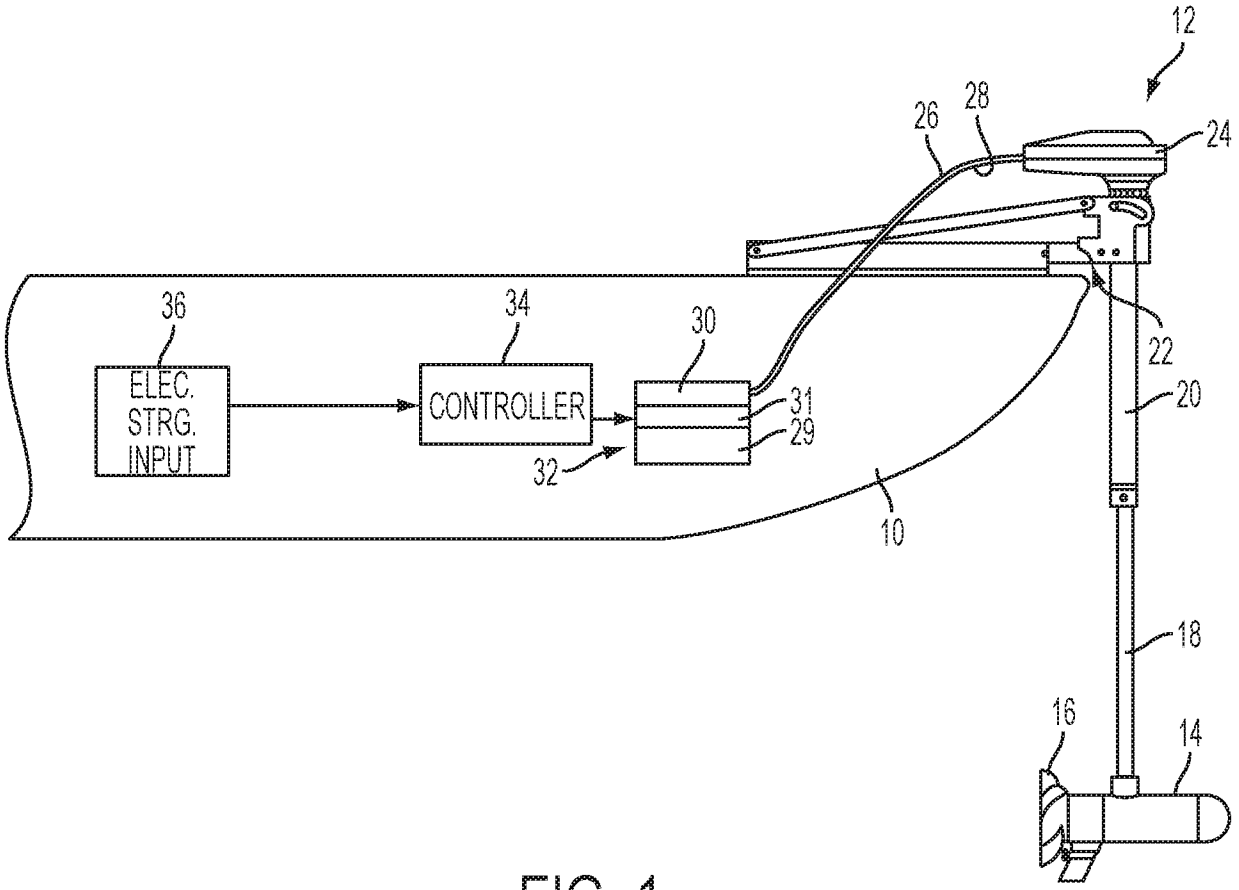
FIG. 1 illustrates a boat equipped with a steering system for a trolling motor.

FIG. 1 illustrates a boat 10 equipped with a trolling motor system 12. As shown in the figure, the trolling motor system 12 is a bow-mounted system; however, the trolling motor system 12 could be provided elsewhere on the boat 10. The trolling motor system 12 includes a trolling motor 14 having a propeller 16 rotatably driven by the trolling motor 14. The trolling motor 14 is connected to a steering shaft 18 rotatably received in a fixed shaft 20, which is mounted to the boat 10 by way of a mounting mechanism 22. The steering shaft 18 is rotationally fixed with respect to the trolling motor 14, and can be rotated within the fixed shaft 20 so as to control the orientation (and direction of thrust) of the trolling motor 14. The trolling motor system 12 further includes a trolling motor head 24 mounted at the top of fixed shaft 20. A mechanical linkage, such as a pair of cables 26, 28, extends from within the head 24 to a mechanical steering input device such as a foot pedal 30, which is provided at a location where an operator of the boat 10 can manipulate it with his foot to control steering of the trolling motor 14.

Together, the foot pedal 30, mechanical linkage (e.g. cables 26, 28), and steering shaft 18 make up a mechanical steering system for the boat 10. The mechanical steering system may also include other gears, pulleys, cables, etc. that may be provided to mechanically link the mechanical steering input device to the trolling motor system 12. In one example, the foot pedal 30, cables 26, 28, and steering shaft 18 are configured as a pull-pull cable system in which cable 26 is wound in one direction around a cable drum fixed to the top of steering shaft 18, and cable 28 is wound in an opposite direction around the cable drum. As will be described further herein below, pressing the foot pedal 30 in one direction will pull on cable 26, while pressing the foot pedal in an opposite direction will pull on cable 28. Due to the opposite windings of cables 26, 28 around the cable drum, pulling on cable 26 rotates steering shaft 18 within fixed shaft 20 in one direction, while pulling on cable 28 rotates steering shaft 18 within fixed shaft in an opposite direction. For example, if a foot pedal 30 is used as the mechanical steering input device, either a toe down or heel down movement of the foot pedal 30 would cause left or right steering of the trolling motor 14. Those having ordinary skill in the art should recognize that different types of mechanical steering input devices besides a foot pedal could be used to input manual steering commands to the left or right. Additionally, various other types of cabled connections from the mechanical steering input device to the steering shaft 18 could be made, and the configuration of the connections described herein is not limiting on the scope of the present disclosure.

FIG. 1 also illustrates an electromechanical actuation system 32 that is configured to be coupled to the foot pedal 30. The electromechanical actuation system 32 may comprise an electric motor assembly 29 (including, for example, an electric motor, gear box, and/or output shaft) and a mechanical coupling device 31 (such as, for example, a clutch, selector ring, or other type of torque-transmitting interface) for coupling the electric motor assembly 29 to the foot pedal 30. The electromechanical actuation system 32 is in signal communication with a controller 34. The controller 34 provides steering signals to the electromechanical actuation system 32 as will be described further herein below. As will also be described below, the electromechanical actuation system 32 can be used to selectively actuate the foot pedal 30 so as to rotate the steering shaft 18 according to the steering signals provided by the controller 34. The controller 34 may include a programmable processor and programmable input/output peripherals. As is conventional, the processor can be communicatively connected to a computer readable medium that includes volatile or non-volatile memory upon which computer readable code is stored. The processor can access the computer readable code on the computer readable medium and upon executing the code, carries out various functions of the trolling motor system 12. Controller 34 can be in wired or wireless signal communication with the electromechanical actuation system 32. The controller 34 may be located as shown in the figure, may be located in the trolling motor head 24, or at any other suitable location aboard the boat 10.

Also included in FIG. 1 is an electrical steering input device 36. The electrical steering input device 36 could comprise one or more of many different input devices, such as but not limited to a remote control device (wired or wireless), an autopilot, a GPS-equipped mapping device such as a chart plotter or fish finder, a depth finder, or any other device capable of accepting and/or generating steering commands for input to the controller 34. In this way, the controller 34 can be operated in an automatic navigation mode in response to input from the electrical steering input device 36. For example, the steering signals might be generated according to an electronic anchoring mode in order to keep the boat 10 at a selected geographical location in the water despite the presence of wind, waves, or other external influences that might tend to move the boat 10 from the selected position. In another example, the steering signals might be used to operate the trolling motor 14 in a waypoint tracking mode, in which the boat 10 is steered along a route of preselected geographical coordinates.

The boat 10 is therefore equipped with a mechanical steering system that includes a mechanical steering input device, such as the foot pedal 30, and a mechanical linkage (e.g. cables 26, 28) extending from the mechanical steering input device to the steering shaft 18 of the trolling motor 14. In another example, the mechanical steering input device might be a hand-held tiller, and the mechanical linkage might be a shaft that connects the hand tiller to the steering shaft 18. Movement of the mechanical steering input device causes movement of the mechanical linkage, which in turn causes rotation of the steering shaft 18. The boat 10 also includes an electromechanical actuation system 32 configured to be coupled to the mechanical steering system and a controller 34 in signal communication with the electromechanical actuation system 32 for providing steering signals thereto. In one example, the steering signals are input via the electrical steering input device 36. According to the present disclosure, the electromechanical actuation system 32 selectively actuates the mechanical steering system so as to rotate the steering shaft 18 according to the steering signals provided by the controller 34. As shown in FIG. 1, the electromechanical actuation system 32 can be provided near the foot pedal 30, and can actuate the foot pedal 30 itself. If the coupling is made at the foot pedal 30, a series of cables and pulleys (see FIGS. 5-10), a rack and pinion assembly, an electric linear actuator, or other forms of mechanical linkages could be used.

Figure 2:
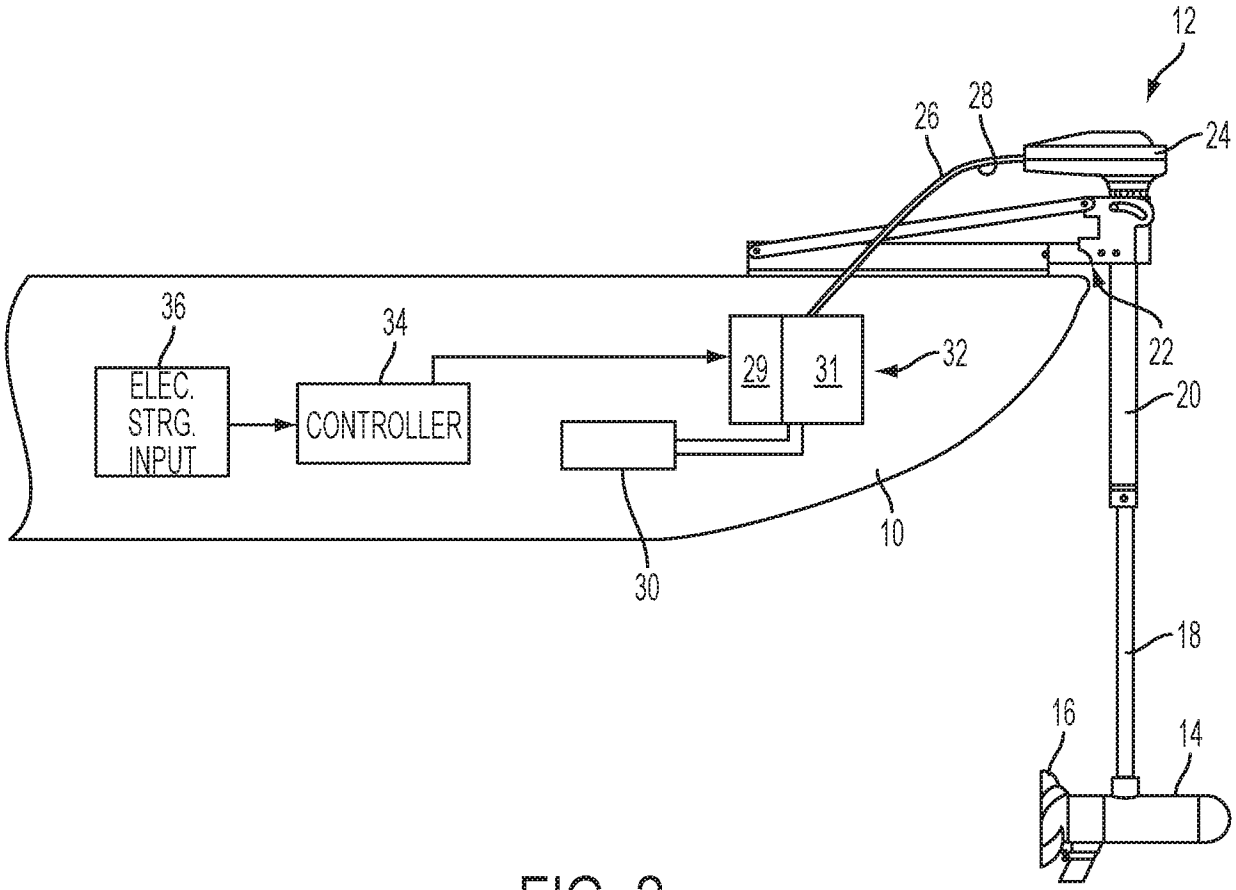
FIG. 2 illustrates a boat equipped with another example of a steering system for a trolling motor.

In an alternative example, as shown in FIG. 2, the electromechanical actuation system 32 may be provided remotely from the foot pedal 30, and may actuate the mechanical linkage (here, the cables 26, 28) directly, instead of actuating the mechanical steering input device, which in turn actuates the mechanical linkage. In this example, the electromechanical actuation system 32 also includes an electric motor assembly 29, for example an electric motor and a gearbox with an output shaft. When the electric motor assembly 29 is coupled to the mechanical steering system by way of a mechanical coupling device 31, the electric motor assembly 29 actuates the cables 26, 28, which in turn rotate the steering shaft 18. A spool and additional cables could be provided to make the connection between the output shaft and the cables 26, 28. In other alternative examples, although not shown herein, the electromechanical actuation system 32 may be provided at the steering shaft 18 of the trolling motor 14 and may directly actuate the steering shaft 18. In this case, a geared motor coupled to the steering shaft 18 could be used. The purpose and function of the controller 34, electrical steering input device 36, and trolling motor system 12 in FIG. 2 are the same as in FIG. 1.

As described above, the foot pedal 30 may actuate the cables 26, 28 to thereby rotate the steering shaft 18, which steers the trolling motor 14 and changes the direction of thrust provided by the propeller 16. Alternatively, the electromechanical actuation system 32 may actuate the foot pedal 30 (FIG. 1), the cables 26, 28 (FIG. 2), or the steering shaft 18 so that the trolling motor 14 may be steered according to steering signals sent from the controller 34 to the electromechanical actuation system 32. This allows a boat 10 equipped with a traditional mechanical steering system to be controlled based on electrical signals from an electrical steering input device 36. The present disclosure thus allows an operator of the boat 10 to select between purely mechanical or electromechanical steering depending on whether he wishes to manually steer the boat 10 with the foot pedal 30 or to have the boat 10 controlled based on inputs from the electrical steering input device 36.

Figure 3:
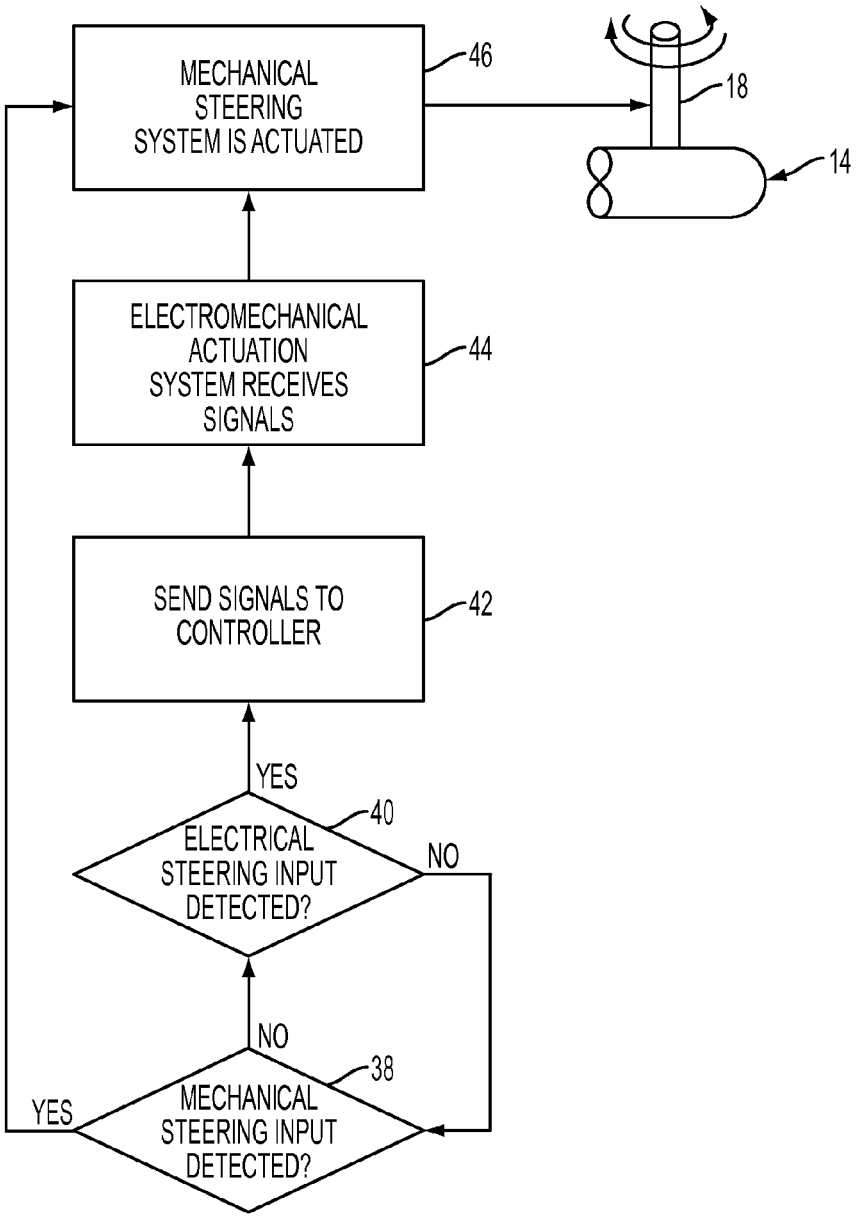
FIG. 3 is a schematic of one example of a system for steering a trolling motor.

Now turning to FIG. 3, a schematic illustration of the inputs to the system shown in FIGS. 1 and 2 will be described. At decision block 38, it is determined whether a mechanical steering input is detected. For example, the mechanical steering input can be in the form of input to or actuation of a mechanical steering input device, such as the foot pedal 30. If YES, the mechanical steering system is actuated (block 46) and the steering shaft 18 of the trolling motor 14 is rotated according to the mechanical steering input. If the answer at block 38 is NO, a decision is made at block 40 as to whether electrical steering input is detected. For example, electrical steering input may be detected automatically when the operator manipulates or interacts with the electrical steering input device 36. In another example, electrical steering input may be detected when the operator flips a switch or presses a button that changes the system from mechanical to electromechanical steering input. If the answer is NO at block 40, the system returns to detecting whether or not mechanical steering input has been provided at block 38.

If electrical steering input has been detected at block 40 (YES), control signals from the electrical steering input device 36 are sent to the controller 34, as shown at block 42. From there, the signals are sent to the electromechanical actuation system 32, as shown at block 44. As shown at block 46, the mechanical steering system is thereafter actuated by the electromechanical actuation system 32. Actuation of the mechanical steering system causes rotation of the steering shaft 18 and therefore rotation of the trolling motor 14 according to the steering signals provided by the electrical steering input device 36. In the example of FIG. 3, the mechanical steering system may be selectively coupled to the electromechanical actuation system 32, for example by actuation of mechanical coupling device 31, such that the electromechanical actuation system 32 actuates the mechanical steering system only when such a coupling has been made. The coupling could be made automatically according to a signal from the controller 34, or the coupling could be accomplished manually such as by the operator of the boat 10 flipping a switch or pressing a button. In one example, if electrical steering input is detected at block 40, the electromechanical actuation system 32 and the mechanical steering system are automatically coupled.

Figure 4:
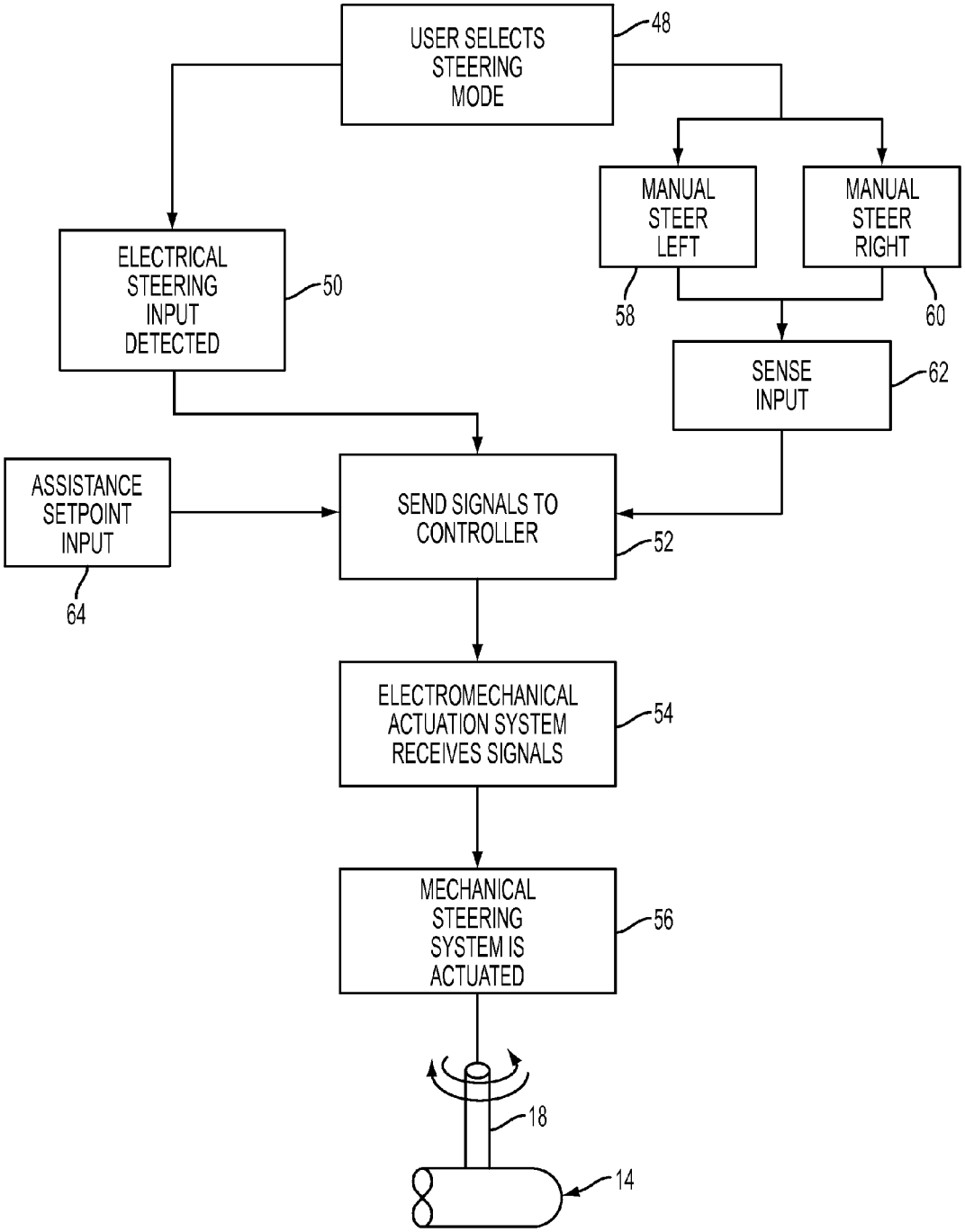
FIG. 4 is a schematic of another example of a system for steering a trolling motor.

Turning now to FIG. 4, a schematic of a system in which the electromechanical actuation system 32 and the mechanical steering system are permanently coupled to one another will be described. As shown at block 48, a user selects a steering mode, which can be either electromechanical or manual, according to which steering input device has been actuated. For example, if the electrical steering input device 36 has been actuated, then the operator has selected an electromechanical steering mode. If a mechanical steering input device, for example the foot pedal 30, has been actuated, the operator has selected a manual steering mode. If the electromechanical steering mode has been selected, as determined at block 50, signals are sent from the electrical steering input device 36 to the controller 34 as shown at block 52. As shown at block 54, the electromechanical actuation system 32 receives these signals, and as shown at block 56, actuates the mechanical steering system to rotate the steering shaft 18 and therefore change the orientation of the trolling motor 14.

Returning back to block 48, if the user selects a manual steering mode, a decision is made at blocks 58 and 60 as to whether the mechanical steering input device is directing the boat 10 to turn to the left or to turn to the right. As shown at block 62, an input to the mechanical steering input device besides merely the direction the operator wishes to turn is also sensed and provided to the controller 34 for processing. For example, a pressure pad could be provided in the foot pedal 30 to sense such an additional input. As an operator pushes down on either the toe or heel of the foot pedal 30, the pressure pad sensor will register a toe down or heel down movement and send a directional signal to the controller 34. The pressure pad sensor may also sense how hard the operator is pushing his heel or toe down, may convert this pressure to a voltage, and the controller 34 may then convert this voltage to a power that is to be provided to the electromechanical actuation system 32. In one example, the voltage thereby determines a speed of an electric motor of the electromechanical actuation system 32, which electric motor actuates the mechanical steering system.

Meanwhile, at block 64, the operator may input an assistance setpoint value. The assistance set point value may adjust how much assistance the electromechanical actuation system 32 provides to rotate the steering shaft 18 when the operator actuates the mechanical steering input device, such as the foot pedal 30. For example, if the operator chooses zero assist, then in order to rotate the trolling motor 14 the operator will need to apply enough force to the foot pedal 30 to both backdrive the electric motor assembly 29 of the electromechanical actuation system 32 and overcome the friction force of water tending to resist rotation of the trolling motor 14. This means the operator would have to apply proportionately more force to the foot pedal 30 than if the assistance setpoint value was higher. For example, if the operator chose a setpoint of 25% assistance, the operator would obtain some level of assistance from the electric motor assembly 29 of the electromechanical actuation system to help rotate the steering shaft 18. In other words, the force the operator needs to apply to the foot pedal 30 will decrease when the adjustable assistance setpoint is higher than zero. The assistance setpoint value could be input by the operator using an input device such as a remote controller, a keypad or touch pad in signal communication with the controller 34, or any other similar means. This input device would allow the operator to select an amount of assistance that the electric motor assembly 29 of the electromechanical actuation system 32 will provide to rotate the steering shaft 18. In one example, the operator could choose an assistance setpoint that provides enough power to the electric motor that the requirement that the operator back drive the electric motor in order to rotate the steering shaft 18 is counteracted. The assistance setpoint could alternatively be set even higher such that the operator does not feel as much resistance in the foot pedal 30 when attempting to rotate the trolling motor 14 against the force of water tending to oppose such rotational force. Therefore, the system of FIG. 4 can be used to "assist" the purely mechanical steering systems of the prior art. The amount of assistance can be adjusted by the operator of the boat according to the desired resistance the operator would like to experience from the mechanical steering input device.

Figure 5:
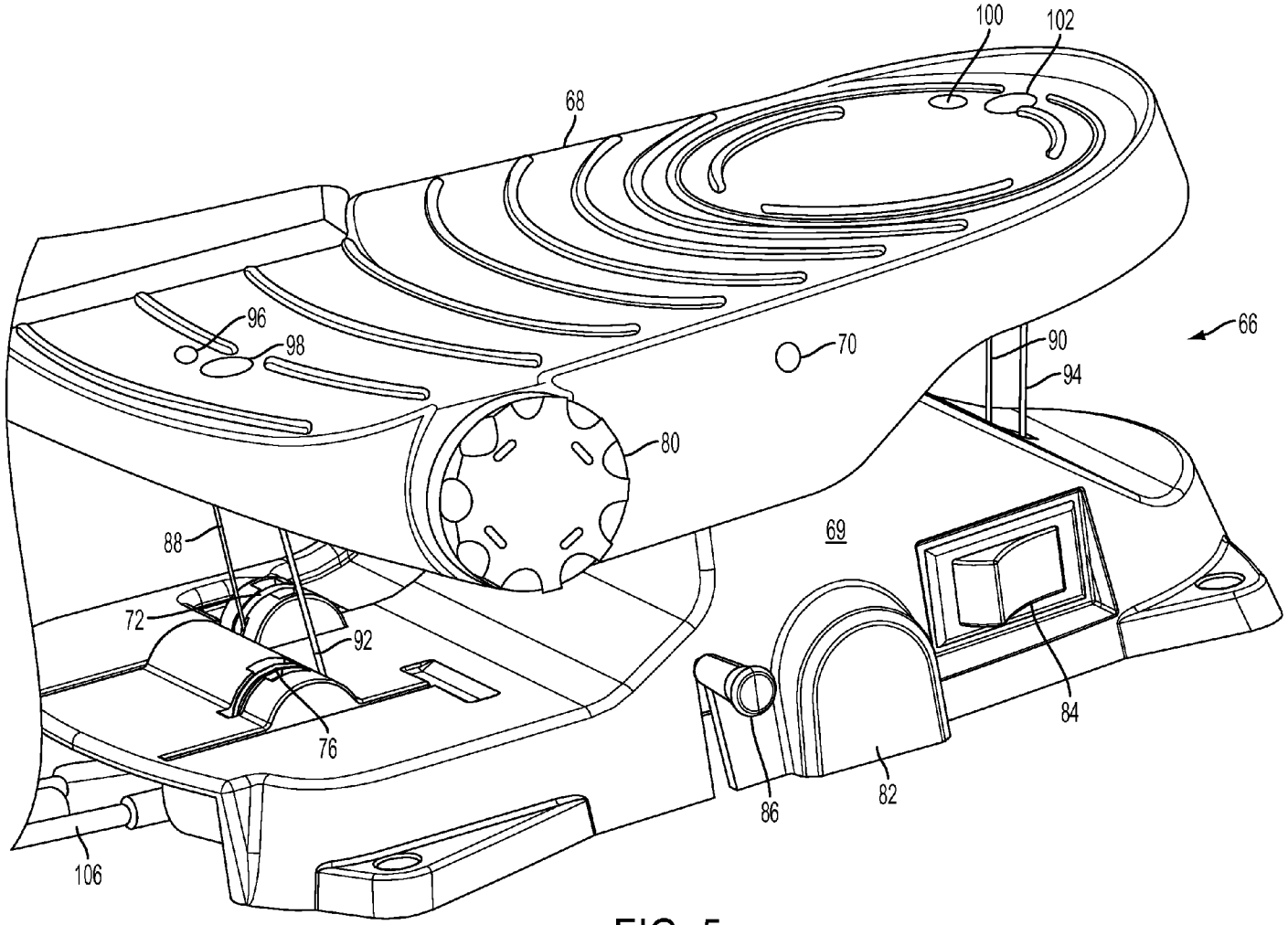
FIG. 5 illustrates one example of a foot pedal according to the present disclosure.

Now turning to FIGS. 5-10, one example of the present disclosure in which the mechanical steering input device is a foot pedal and the electromechanical actuation system actuates the foot pedal will be described. FIG. 5 illustrates a foot pedal 66, which may be the same as foot pedal 30 shown in FIGS. 1 and 2. The foot pedal 66 includes a tread 68 that is rotatable relative to a base 69 about a pivot pin 70 in either a heel down or toe down direction. In one example, a toe down movement produces right, or clockwise, rotation of the trolling motor 14 and a heel down movement produces left, or counterclockwise, rotation of the trolling motor 14. It should be understood that opposite rotations could be produced from a toe down or heel down motion, and such a relationship does not limit the scope of the present claims. The foot pedal 66 includes a first idler pulley 72, a second idler pulley 74 (see FIGS. 7 and 8), a third idler pulley 76, and a fourth idler pulley 78 (see FIGS. 7 and 8). The foot pedal 66 also includes a speed control knob 80 which can be rotated to provide greater or less speed to the propeller 16 of the trolling motor 14. Also provided are an electric motor 82 and an on/off switch 84 for turning the electric motor 82 on or off. The foot pedal 66 further includes a selector pin 86, the purpose of which will be described further herein below. Four separate cables extend around the first, second, third and fourth idler pulleys and are labeled with reference numerals 88, 90, 92, and 94, respectively. The cables 88 and 92 are connected to the toe of the tread 68 by anchors 96, 98, while the cables 90, 94 are connected to the heel of the tread 68 by anchors 100, 102.

Figure 6:
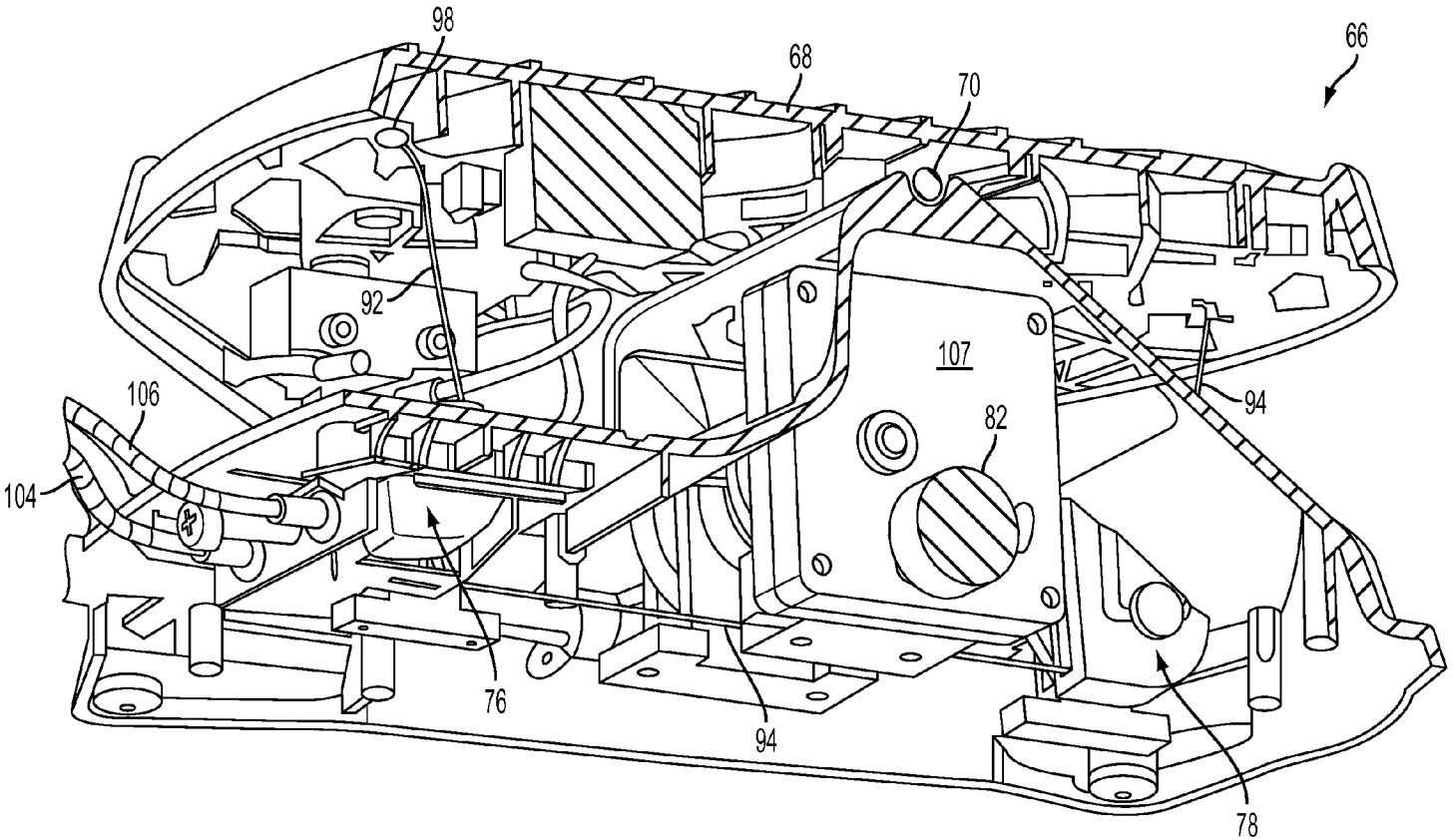
FIG. 6 illustrates a left cross-sectional view of the foot pedal of FIG. 5.

Now turning to FIG. 6, operation of the foot pedal 66 in a purely mechanical mode will be described. The tread 68, when operated such that it rotates around the pivot pin 70 in a toe down direction, causes the cable 94 to be pulled upwardly by the heel of the tread 68. The cable 94 is wound around the fourth idler pulley 78 and is connected to and pulls on a cable 104 that is coupled to the steering shaft 18 of the trolling motor system 12. This rotates the trolling motor 14 in a clockwise direction. Alternatively, when the tread 68 of the foot pedal 66 is operated such that the heel is pushed down, this pulls on cable 92, which is wound around third idler pulley 76, and attached to cable 106, which is coupled to the steering shaft 18, but wound oppositely of cable 104, as described hereinabove with respect to cables 26, 28. This heel down movement thus causes rotation of the trolling motor 14 in a counterclockwise direction. For clarity, the first and second idler pulleys 72, 74 and cables 88, 90, which make up parts of the electromechanical actuation system, are not shown in FIG. 6.

Figure 7:
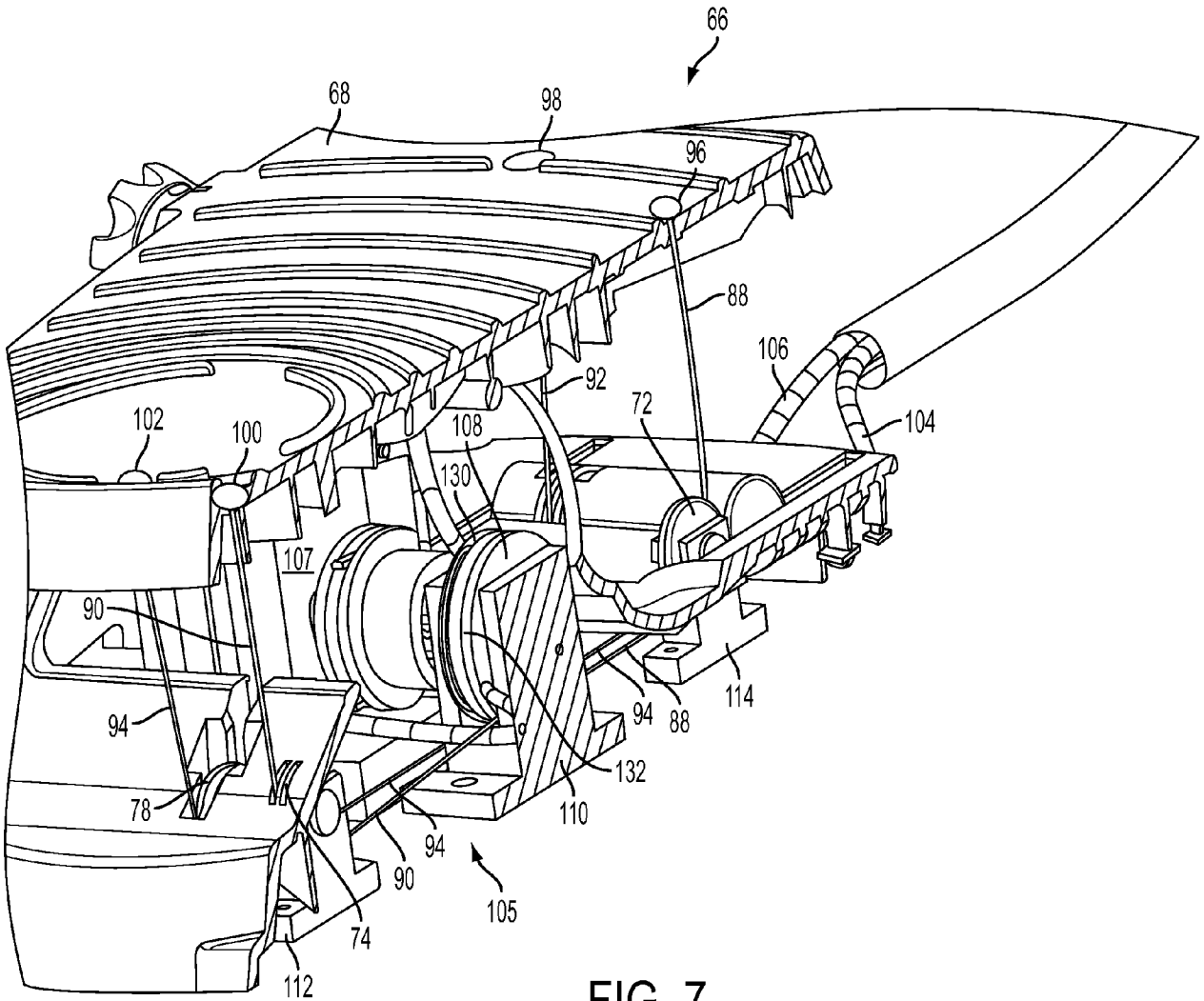
FIG. 7 illustrates a right cross-sectional view of the foot pedal of FIG. 5.

Turning to FIG. 7, the electromechanical actuation system of the foot pedal 66 will be described. The electromechanical actuation system 105 (corresponding to reference numeral 32 in FIG. 1) includes an electric motor 82 (see FIG. 6) and an associated gearbox 107 having an output shaft 122 that is selectively coupled to the mechanical steering system. The electromechanical actuation system 105 further includes a driven pulley 108 that is driven by the electric motor 82 via a coupling to the gearbox 107 as will be described further herein below. The driven pulley 108 is held on a pulley support 110 and can be rotated in opposite directions around a shaft running through the center of the driven pulley 108 and held by the support 110. The driven pulley 108 has two grooves 130, 132 that extend around the circumference of the driven pulley 108 on opposite halves thereof (See also FIG. 9.) The cable 90 is wound around one half of the driven pulley 108 in the groove 132, and one end of the cable 90 is anchored in the groove 132. The cable 90 is then wound around the bottom of the second idler pulley 74, and its opposite end is connected to the heel of the tread 68 at anchor 100. The cable 88 is wound around the other half of the driven pulley 108 in the groove 130, and one end of the cable 88 is anchored in the groove 130. The cable 88 is then wound around the bottom of the first idler pulley 72, and its opposite end is connected to the toe of the tread 68 at anchor 96. Second idler pulley 74 is held on pulley support 112, while first idler pulley 72 is held on pulley support 114.

Figure 8:
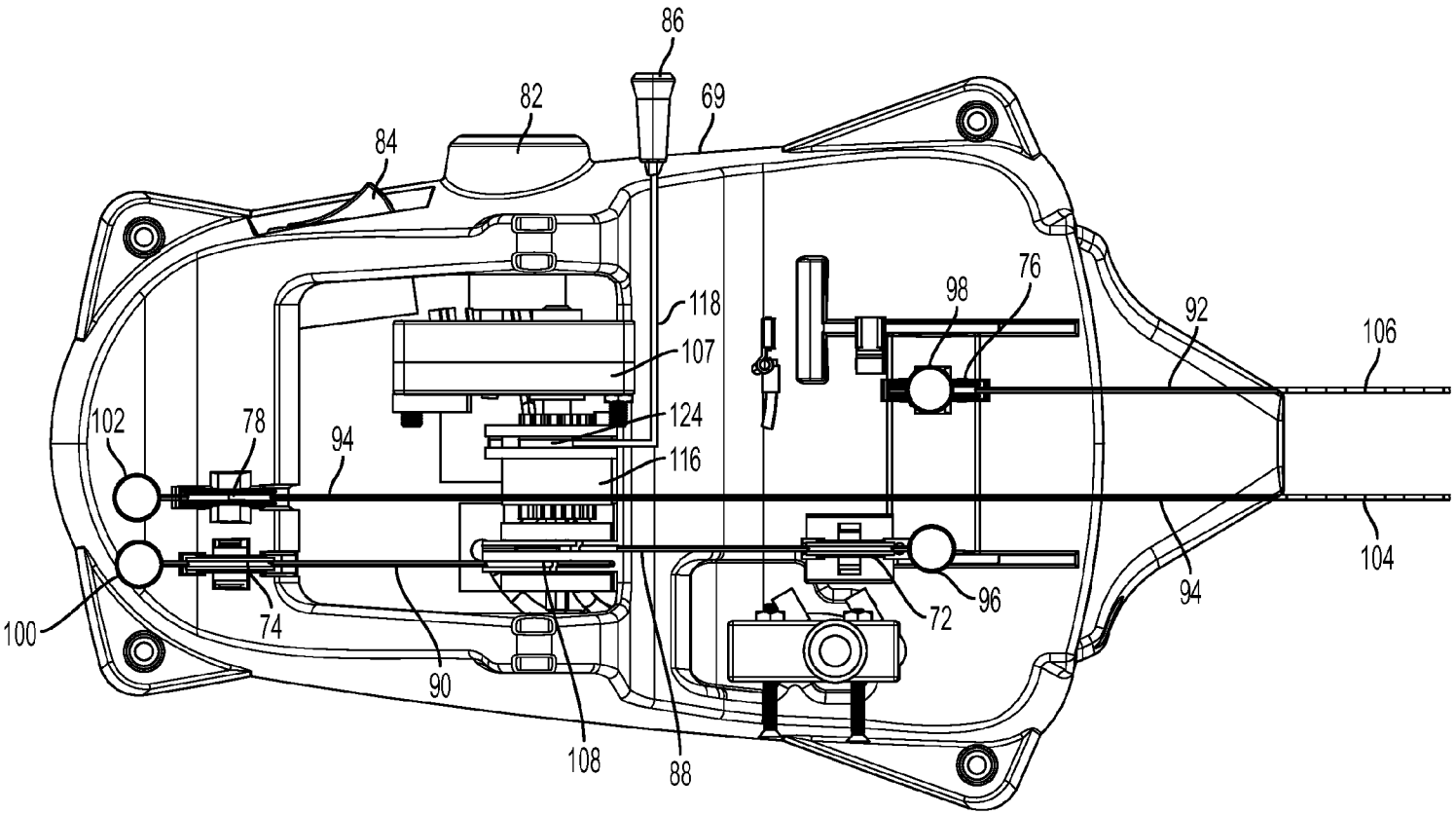
FIG. 8 illustrates a top cross-sectional view of the foot pedal.
Figure 9:
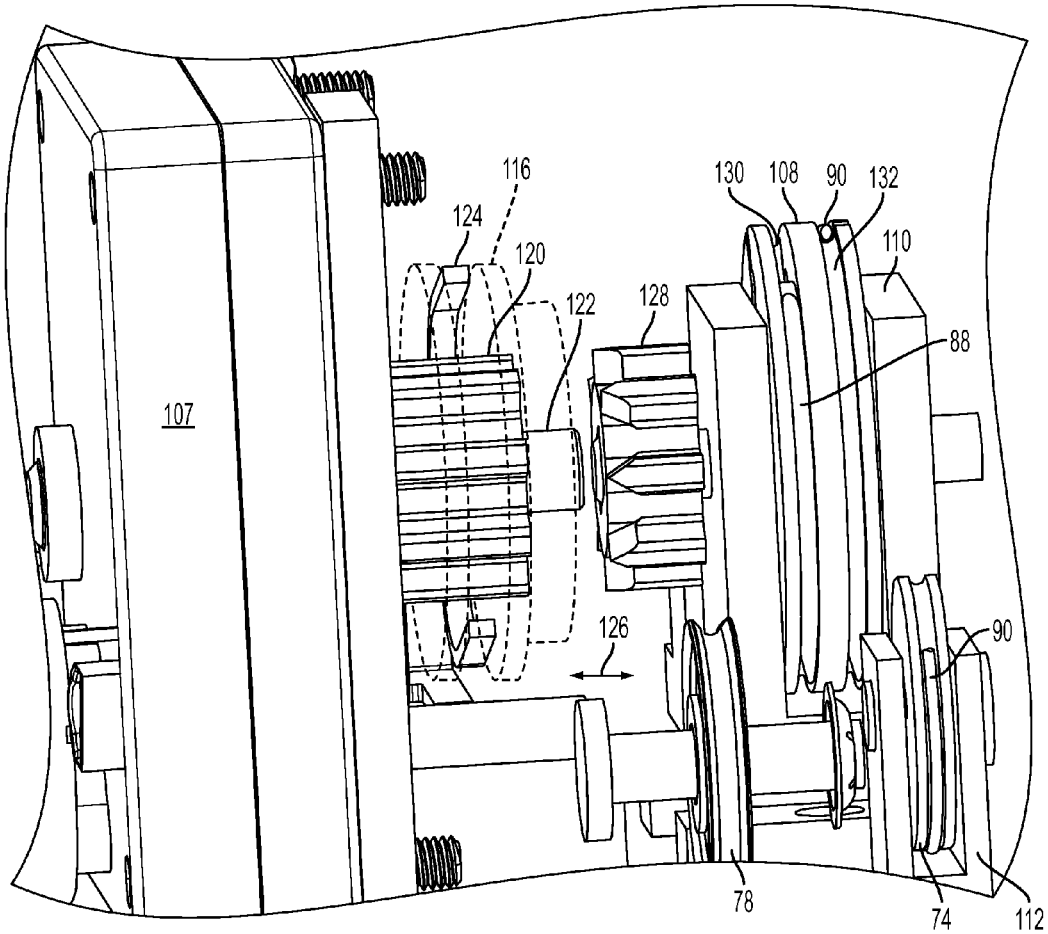
FIGS. 9 and 10 illustrate internal components of the foot pedal.

Now turning to FIGS. 8 and 9, details of how the electromechanical actuation system 105 may actuate the tread 68 of the foot pedal 66 are further described. The electromechanical actuation system 105 comprises a mechanical coupling device for coupling the output shaft 122 to the mechanical steering system. In one example, the mechanical coupling device comprises a clutch, such as a selectively engageable selector ring 116, that couples the output shaft 122 to and decouples the output shaft 122 from the mechanical steering system. For example, FIG. 8 shows how the selector ring 116 is connected via a rod 118 to the selector pin 86. The selector ring 116 is shown in dashed lines in FIG. 9 so as to show an output gear 120 extending from the gearbox 107 around the output shaft 122. The output shaft 122 and therefore the output gear 120 of the gearbox 107 are rotated by the electric motor 82. The selector ring 116 is partially surrounded by a selector actuator, in the form of a C-shaped ring 124 that fits into a groove of the selector ring 116. The C-shaped ring 124 is connected to the rod 118, which is connected to the selector pin 86 as shown in FIG. 8. When the selector pin 86 is pushed in toward or pulled away from the base 69, this moves the rod 118, in turn moving the selector ring 116 due to coupling of the rod 118 with the selector ring 116 via C-shaped ring 124. In this way, the selector ring 116 can be actuated in two directions as shown by arrow 126.

When the selector pin 86 is pushed in toward the base 69, the selector ring 116 moves to the right as shown by arrow 126 and is made to mesh with an input gear 128 of the driven pulley 108. (See position in FIG. 10.) The inner circumference of the selector ring 116 is provided with splines that correspond to the teeth on the output gear 120 and teeth on the input gear 128. This allows rotation of the output gear 120 to be transferred to rotation of the input gear 128 when the selector ring 116 is meshed with both gears. This way, rotation of the output shaft 122 and thus output gear 120 of the gearbox 107 by the electric motor 82 produces rotation of the driven pulley 108. When the selector pin 86 is pulled out away from the base 69, the selector ring 116 moves to the left as shown by arrow 126, the output shaft 122 is decoupled from the mechanical steering system, and the steering shaft 18 can be rotated by purely mechanical means in response to application of force to the mechanical steering input device, i.e. foot pedal 66.

In other examples, the selector pin 86 may be replaced with an operator-controlled button or switch on the foot pedal 66, or provided in another device such as a remote control. Alternatively, the electromechanical actuation system 105 and mechanical steering system might be automatically coupled when an operator takes his foot off the foot pedal 66 and then activates the electrical steering input device 36. The coupling between the electromechanical actuation system 105 and mechanical steering system might be disengaged by the operator again pressing on the foot pedal 66, or by the operator again hitting the button or switch.

The foot pedal 66 of FIGS. 5-10 therefore corresponds to the system of FIG. 1, in which the output shaft 122 is coupled to the mechanical steering system, and the electric motor 82 actuates the mechanical steering input device, which in turn actuates the cables 104, 106, which in turn rotate the steering shaft 18. The foot pedal 66 of FIGS. 5-10 also corresponds to the system of FIG. 3, in which the electromechanical actuation system 32 can be selectively coupled to the mechanical steering system, for example by movement of the selector ring 116 according to movement of the selector pin 86. If the selector ring 116 permanently coupled the output gear 120 of the gearbox 107 to the input gear 128 of the driven pulley 108, this would correspond to the system described in FIG. 4.

Figure 10:
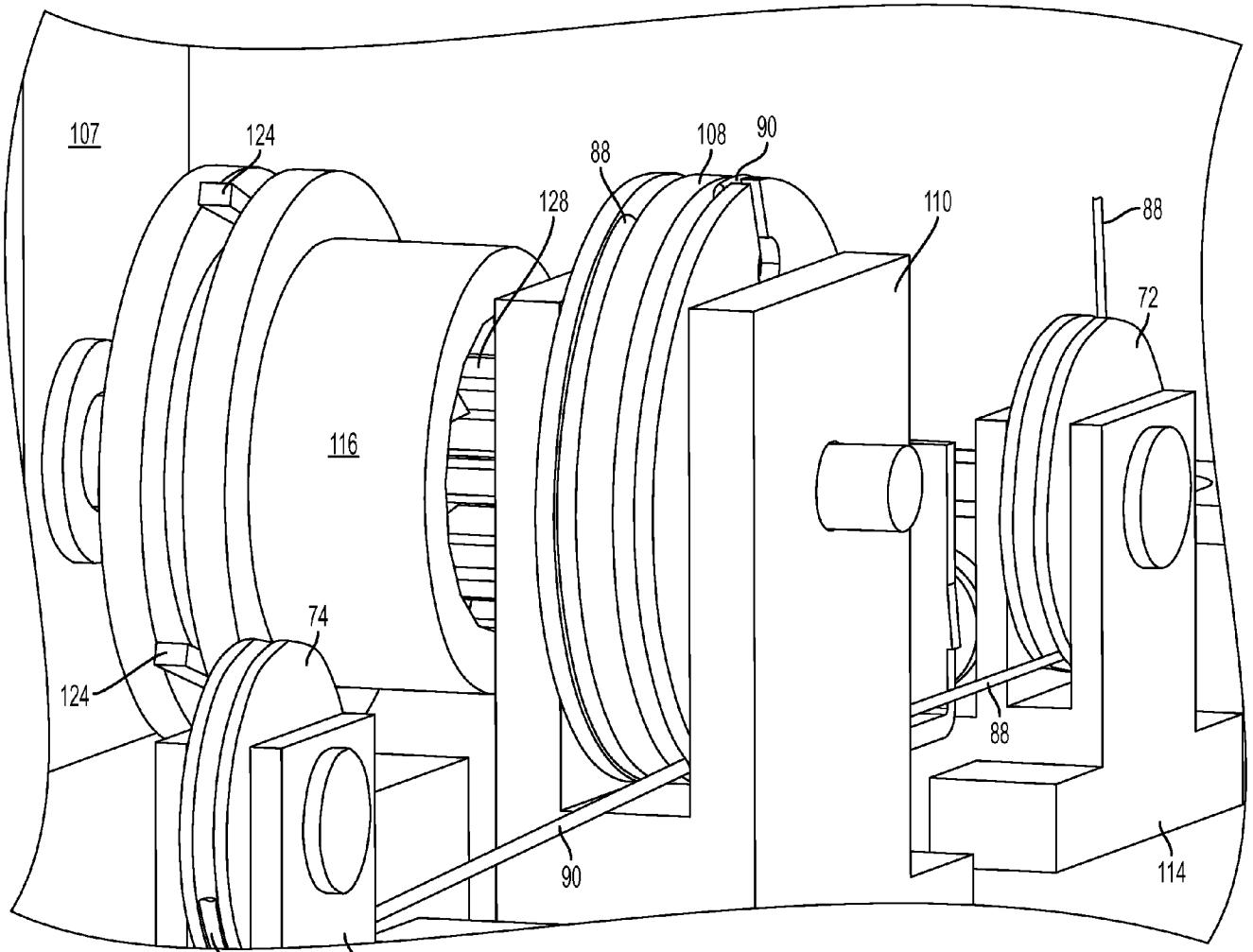

Rotation of the driven pulley 108 in a first direction winds cable 90 further around the driven pulley 108 and pulls the heel of the tread 68 in a downward direction, due to connection of the cable 90 to the heel of the tread 68 at anchor 100. This in turn pulls the cable 92 connected at anchor 98 in an upward direction, and pulls on cable 106 to rotate the steering shaft 18 and produce a counterclockwise movement of the trolling motor 14. When the driven pulley 108 is rotated in an opposite direction, this winds cable 88 further around driven pulley 108 and pulls the toe of the foot pedal 66 down due to connection at anchor 96. This pulls the cable 94 up, and pulls on connected cable 104, thereby rotating the steering shaft 18 and producing a clockwise movement of the trolling motor 14. Although the near end of the cable 90 in FIGS. 9 and 10 and the far end of the cable 88 in FIG. 10 are shown as being cut off, it should be understood that these ends in fact extend to the tread 68 and are connected thereto by anchors 100, 96, respectively.

In other words, the foot pedal 66 is actuated by the electromechanical actuation system 105 in order to provide a toe down or heel down movement of the foot pedal 66, which in turn produces movement of the cables 106 and 104 that are connected to the steering shaft 18 of the trolling motor 14. In this way, signals sent to the electric motor 82 from the controller 34, according to inputs from the electrical steering input device 36, can be used to actuate the driven pulley 108 and thereafter the mechanical steering input device (foot pedal 66) and thereby steer the trolling motor 14.

The steering system of FIGS. 5-10 therefore includes a mechanical steering system including foot pedal 66 and a first cable 104 extending from the foot pedal 66 to a steering shaft 18 of the trolling motor 14. Movement of the foot pedal 66 in a first direction causes movement of the first cable 104, which in turn causes rotation of the steering shaft 18 in a first direction. A second cable 106 extends from the foot pedal 66 to the steering shaft 18 of the trolling motor 14, and movement of the foot pedal 66 in a second direction causes movement of the second cable 106, which in turn causes rotation of the steering shaft 18 in a second direction. An electromechanical actuation system 105 is supplementary to the mechanical steering system. The electromechanical actuation system 105 includes an electric motor 82 having an associated gearbox 107 with an output shaft 122 and a driven pulley 108 that is selectively coupled to the output shaft 122 such that the driven pulley 108 can be rotated by the electric motor 82. A selector ring 116 is provided to couple an output gear 120 on the output shaft 122 of the gearbox 107 to an input gear 128 on the driven pulley 108.

A third cable 88 is coupled to the driven pulley 108, wound around a first idler pulley 72, and coupled to a first region of the foot pedal 66, and rotation of the driven pulley 108 in a first direction causes movement of the foot pedal 66 in the first direction, which in turn causes movement of the first cable 104 (via cable 94), which in turn causes rotation of the steering shaft 18 in the first direction. A fourth cable 90 is coupled to the driven pulley 108, wound around a second idler pulley 74, and coupled to a second region of the foot pedal 66, wherein rotation of the driven pulley 108 in a second, opposite direction causes movement of the foot pedal 66 in the second direction, which in turn causes movement of the second cable 106 (via cable 92), which in turn causes rotation of the steering shaft 18 in the second direction. A controller 34 is in signal communication with the electric motor 82 for providing signals thereto related to a direction of rotation of the output shaft 122 of the gearbox 107.

Figure 11:
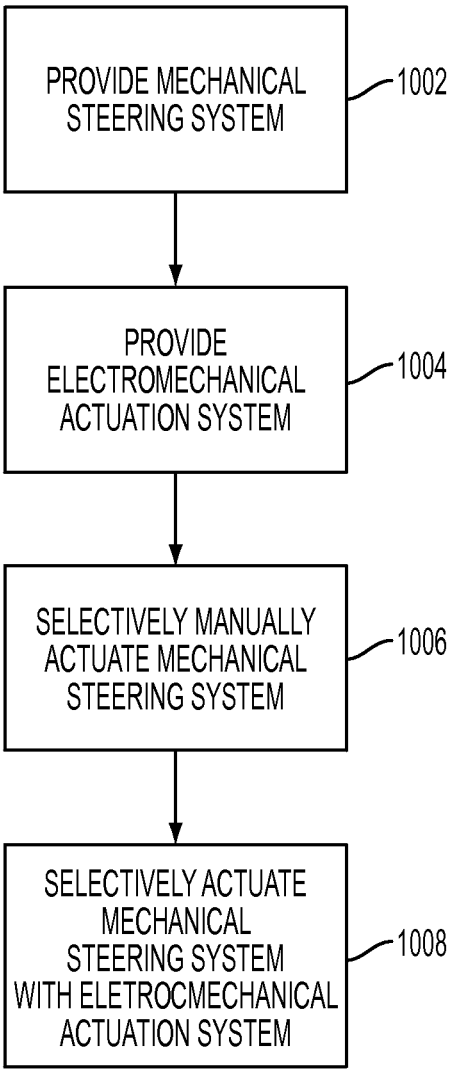
FIG. 11 illustrates an example of a method for steering a trolling motor.

Now turning to FIG. 11, a method for steering a trolling motor 14 will be described. The method comprises, as shown at 1002, providing a mechanical steering system including a mechanical steering input device and a mechanical linkage (e.g. cable 26 or 28) extending from the mechanical steering input device to a steering shaft 18 of the trolling motor 14. As shown at 1004, the method may also include providing an electromechanical actuation system 32 configured to be coupled to the mechanical steering system. As shown at 1006, the method may include selectively manually actuating the mechanical steering system so as to rotate the steering shaft 18. As shown at 1008, the method may further include selectively actuating the mechanical steering system with the electromechanical actuation system 32 so as to rotate as the steering shaft 18.

In other embodiments, the method may further include comprising providing a controller 34 in signal communication with the electromechanical actuation system 32 that provides steering signals thereto, and operating the controller 34 in an automatic navigation mode. The method may further comprise selectively coupling the electromechanical actuation system 32 to the mechanical steering system. The method may further comprise rotating the steering shaft 18 by purely mechanical means in response to operator input (e.g., application of force) to the mechanical steering input device when the electromechanical actuation system 32 is decoupled from the mechanical steering system. The method may further comprise permanently coupling the electromechanical actuation system 32 to the mechanical steering system. The method may further comprise providing a varying level of assistance from the electromechanical actuation system 32 to rotate the steering shaft 18.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A steering system for a trolling motor, the steering system comprising:

a mechanical steering system including:

a mechanical steering input device; and a mechanical linkage extending from the mechanical steering input device to a steering shaft that controls an orientation of the trolling motor, wherein movement of the mechanical steering input device causes movement of the mechanical linkage, which in turn causes rotation of the steering shaft;

an electromechanical actuation system configured to be coupled to the mechanical steering system; and a controller in signal communication with the electromechanical actuation system for providing steering signals thereto;

wherein the electromechanical actuation system selectively actuates the mechanical steering system so as to rotate the steering shaft according to the steering signals provided by the controller.

2. The steering system of claim 1, wherein the electromechanical actuation system comprises an electric motor assembly configured to be coupled to the mechanical steering system.

3. The steering system of claim 2, further comprising a mechanical coupling device for selectively coupling the electric motor assembly to the mechanical steering system.

4. The steering system of claim 3, wherein the mechanical coupling device comprises a selectively engageable clutch that couples the electric motor assembly to and decouples the electric motor assembly from the mechanical steering system.

5. The steering system of claim 3, wherein when the electric motor assembly is decoupled from the mechanical steering system, the steering shaft can be rotated by purely mechanical means in response to operator input to the mechanical steering input device.

6. The steering system of claim 5, wherein when the electric motor assembly is coupled to the mechanical steering system, the electric motor assembly actuates the mechanical linkage, which in turn rotates the steering shaft.

7. The steering system of claim 6, wherein when the electric motor assembly is coupled to the mechanical steering system, the electric motor assembly actuates the mechanical steering input device, which in turn actuates the mechanical linkage, which in turn rotates the steering shaft.

8. The steering system of claim 7, wherein the electromechanical actuation system comprises a series of pulleys and cables actuated by the electric motor assembly, and wherein the mechanical steering input device comprises a foot pedal that is connected to the series of pulleys and cables and that is actuated when the series of pulleys and cables is actuated.

9. The steering system of claim 2, further comprising a mechanical coupling device that permanently couples the electric motor assembly to the mechanical steering system.

10. The steering system of claim 9, further comprising a user input device that allows an operator of the trolling motor to select an amount of assistance that the electromechanical actuation system will provide to rotate the steering shaft.

11. The steering system of claim 1, further comprising an electrical steering input device, wherein the controller can be operated in an automatic navigation mode in response to input from the electrical steering input device.

12. The steering system of claim 11, wherein the automatic navigation mode comprises a waypoint tracking mode.

13. The steering system of claim 1, wherein the mechanical linkage comprises a cable.

14. A method for steering a trolling motor, the method comprising:

providing a mechanical steering system including a mechanical steering input device and a mechanical linkage extending from the mechanical steering input device to a steering shaft that controls an orientation of the trolling motor;

providing an electromechanical actuation system that is configured to be coupled to the mechanical steering system;

selectively manually actuating the mechanical steering system so as to rotate the steering shaft; and selectively actuating the mechanical steering system with the electromechanical actuation system so as to rotate the steering shaft.

15. The method of claim 14, further comprising providing a controller in signal communication with the electromechanical actuation system that provides steering signals thereto.

16. The method of claim 15, further comprising operating the controller in an automatic navigation mode.

17. The method of claim 14, further comprising selectively coupling the electromechanical actuation system to the mechanical steering system.

18. The method of claim 17, further comprising rotating the steering shaft by purely mechanical means in response to operator input to the mechanical steering input device when the electromechanical actuation system is decoupled from the mechanical steering system.

19. The method of claim 14, further comprising permanently coupling the electromechanical actuation system to the mechanical steering system.

20. The method of claim 19, further comprising providing a varying level of assistance from the electromechanical actuation system to rotate the steering shaft.

* * * * *